US009384602B2

(12) United States Patent
Chu

(10) Patent No.: US 9,384,602 B2
(45) Date of Patent: Jul. 5, 2016

(54) DIAGNOSTIC DEVICE FOR VEHICLE

(71) Applicant: Henry C. Chu, Orange, CA (US)

(72) Inventor: Henry C. Chu, Orange, CA (US)

( * ) Notice: Subject to any disclaimer, the term of this patent is extended or adjusted under 35 U.S.C. 154(b) by 0 days.

(21) Appl. No.: 14/538,988

(22) Filed: Nov. 12, 2014

(65) Prior Publication Data

US 2016/0133068 A1 May 12, 2016

(51) Int. Cl.
*G07C 5/08* (2006.01)

(52) U.S. Cl.
CPC ..... *G07C 5/0808* (2013.01); *G07C 5/0825* (2013.01)

(58) Field of Classification Search
CPC ..... G07C 5/0808; G07C 5/0825
See application file for complete search history.

(56) References Cited

U.S. PATENT DOCUMENTS 4,249,130 A 2/1981 Goss
4,942,356 A 7/1990 Ellingen et al.
5,210,444 A 5/1993 Johnson
5,278,508 A * 1/1994 Bowman ..... G01R 31/2832 324/103 R
5,367,200 A 11/1994 Leonida
6,012,004 A * 1/2000 Sugano ..... G06F 11/1691 701/33.4
2001/0016790 A1* 8/2001 Kubo ..... F02D 37/02 701/34.4
2003/0038637 A1* 2/2003 Bertness ..... G01R 31/3624 324/426
2008/0119981 A1* 5/2008 Chen ..... G05B 23/0267 701/31.4
2009/0299900 A1* 12/2009 Chen ..... G06Q 20/102 705/40
2010/0262404 A1* 10/2010 Bertness ..... G01R 31/007 702/183
2013/0106596 A1* 5/2013 Mouchet ..... B60C 23/02 340/445
2015/0269788 A1* 9/2015 Elliott ..... G06Q 20/18 701/31.5

* cited by examiner

*Primary Examiner* — Rodney Butler
(74) *Attorney, Agent, or Firm* — Charles E. Baxley

(57) ABSTRACT

A diagnostic device for vehicle includes a housing having a display and a control panel, a control unit connected to the housing, a number of input sensors connected to the control unit for sending input signals to the control unit, and for displaying the input signals on the display, and a number of actuators connected to the control unit for being controlled and actuated by the control unit. The control unit includes an input interface circuit for connecting to the input sensors. The control unit includes an output operation circuit for connecting to the actuators.

5 Claims, 5 Drawing Sheets

DIAGNOSTIC DEVICE FOR VEHICLE

BACKGROUND OF THE INVENTION

1. Field of the Invention

The present invention relates to a diagnostic or analysis device for vehicles, and more particularly to a diagnostic or analysis device including an improved and simplified structure or configuration for allowing the user or worker to easily and quickly and readily and effectively diagnose or analyze different parameters of the vehicular engine or air conditioning system of the vehicles, or to identify one or more malfunctions in a locomotive air compressing system and for repairing the locomotive air compressing system.

2. Description of the Prior Art

In conducting an analysis of a vehicular engine, it is common to analyze a number of different parameters with a collection of different meters to perform the various analyses, such as the volt/ohm meter, the primary tacho/dwell meter, the secondary tachometer, the DC current meter, the thermometer, and the pressure meter, etc. This is expensive because the workers have to purchase the entirety of a number of different meters. But, there is much circuitry in common among the various meters.

For example, U.S. Pat. No. 4,249,130 to Goss, U.S. Pat. No. 4,942,356 to Ellingen et al., U.S. Pat. No. 5,210,444 to Johnson, and U.S. Pat. No. 5,367,200 to Leonida disclose several of the typical diagnostic or analysis device for vehicles, particularly for diagnosing or analyzing different parameters of the vehicular engine, air conditioning system, etc. of the vehicles, or for identifying one or more malfunctions in a locomotive air compressing system.

However, the typical diagnostic or analysis devices for diagnosing or analyzing the vehicular engine, air conditioning system, etc. of the vehicles may not be easily used to diagnose or analyze different parameters of the vehicular engine, air conditioning system, etc. of the vehicles, or to identify one or more malfunctions in a locomotive air compressing system.

The present invention has arisen to mitigate and/or obviate the afore-described disadvantages of the conventional diagnostic or analysis devices.

SUMMARY OF THE INVENTION

The primary objective of the present invention is to provide a diagnostic or analysis device including an improved and simplified structure or configuration for allowing the user or worker to easily and quickly and readily and effectively diagnose or analyze different parameters of the vehicular engine or air conditioning system of the vehicles, or to identify one or more malfunctions in a locomotive air compressing system and for repairing the locomotive air compressing system.

In accordance with one aspect of the invention, there is provided a diagnostic device for vehicle comprising a housing including a display and a control panel provided thereon, a control unit connected to the housing, a number of input sensors connected to the control unit for sending input signals to the control unit, and for displaying the input signals on the display, and a number of actuators connected to the control unit for being controlled and actuated by the control unit with the input signals.

The control unit includes an input interface circuit for connecting to the input sensors. The control unit includes a central processing unit and an analogue to digital converter connected to the input interface circuit.

The control unit includes an output operation circuit for connecting to the actuators and for connecting to the central processing unit. The housing includes a power source connected to the housing.

The housing includes an attachment for connecting to the actuators with a number of connectors. The connectors are connected in series. The housing includes an attachment for connecting to a number of connectors. The connectors are connected in series.

The control panel of the housing includes a switch for switching and selecting either of three scan circuits: a first scan circuit S1, a second scan circuit S2, a third scan circuit S3. The first scan circuit S1 is a normal mode, the second scan circuit S2 is a manual mode, and the third scan circuit S3 is a check resistance mode.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
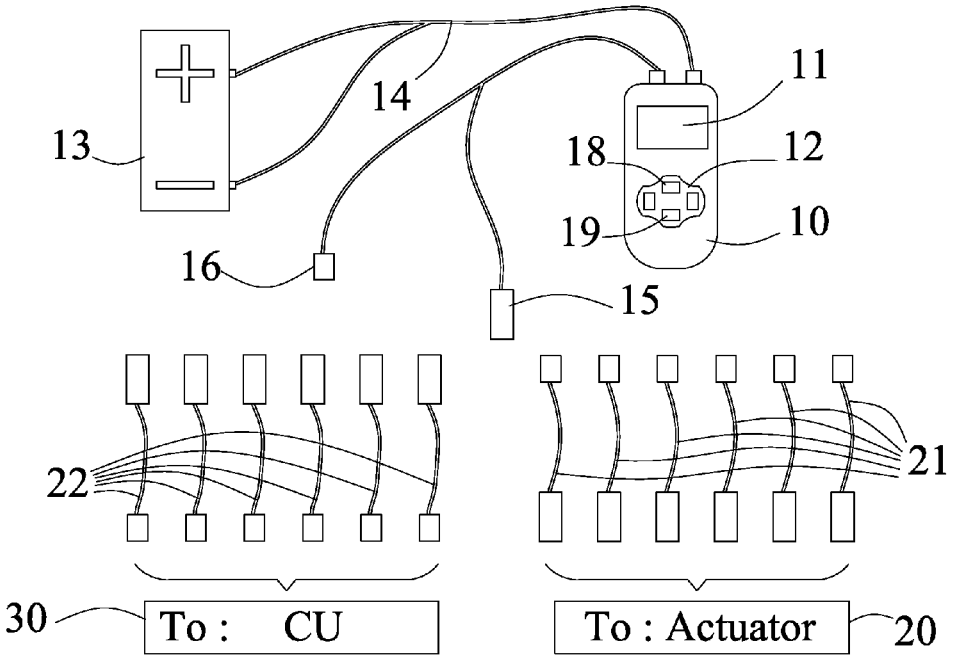
FIG. 1 is a partial exploded view of a diagnostic or analysis device in accordance with the present invention.

Referring to the drawings, and initially to FIG. 1, a diagnostic or analysis device in accordance with the present invention comprises a receptacle or housing 10 including a screen or display 11 formed or provided therein, and including a control panel 12 formed or provided thereon, a power source 13, such as a battery 13 is provided for connecting or coupling to the housing 10 with a connecting cable 14 for energizing the display 11 or the like, and the housing 10 further includes one or more (such as two) connectors or adapters or attachments 15, 16 electrically connected or coupled to the housing 10, in which the one or first attachment 15 is provided for connecting or coupling to the actuators 20 with one or more adapters or connectors 21, in series, and the other or second attachment 16 is provided for connecting or coupling to a control unit 30, such as an electrical or diagnostic control unit 30 with one or more adapters or connectors 22, in series.

Figure 3:
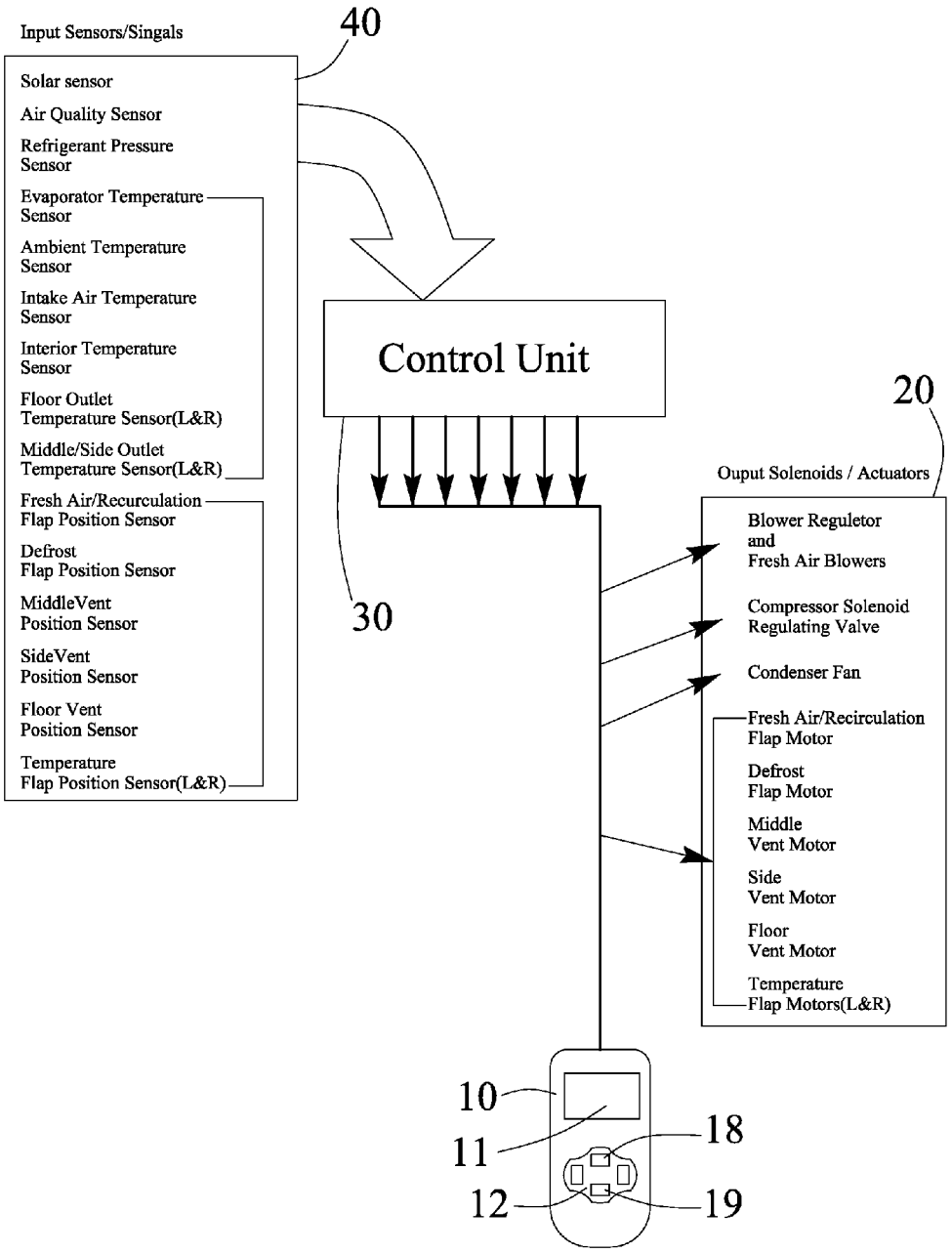
FIG. 3 is a block diagram illustrating the operation of the diagnostic or analysis device.

As shown in FIG. 3, the actuators 20 may be selected from outlet sensors or solenoids, such as: blower regulator and fresh air blowers, compressor solenoid regulating valve, condenser fan, fresh air recirculation flap motor, defrost flap motor, middle vent motor, side vent motor, floor vent motor, temperature flap motor etc., and the electrical control unit 30 is to be connected or coupled to the input sensors 40, such as: solar sensor, air quality sensor, refrigerant pressure sensor, evaporator temperature sensor, ambient temperature sensor, intake air temperature sensor, interior temperature sensor, floor outlet temperature sensors, middle/side outlet temperature sensors, fresh air recirculation flap position sensor, defrost flap position sensor, middle vent position sensor, side vent position sensor, floor vent position sensor, or temperature flap position sensors, etc., for receiving the input signals from the input sensors 40.

Figure 2:
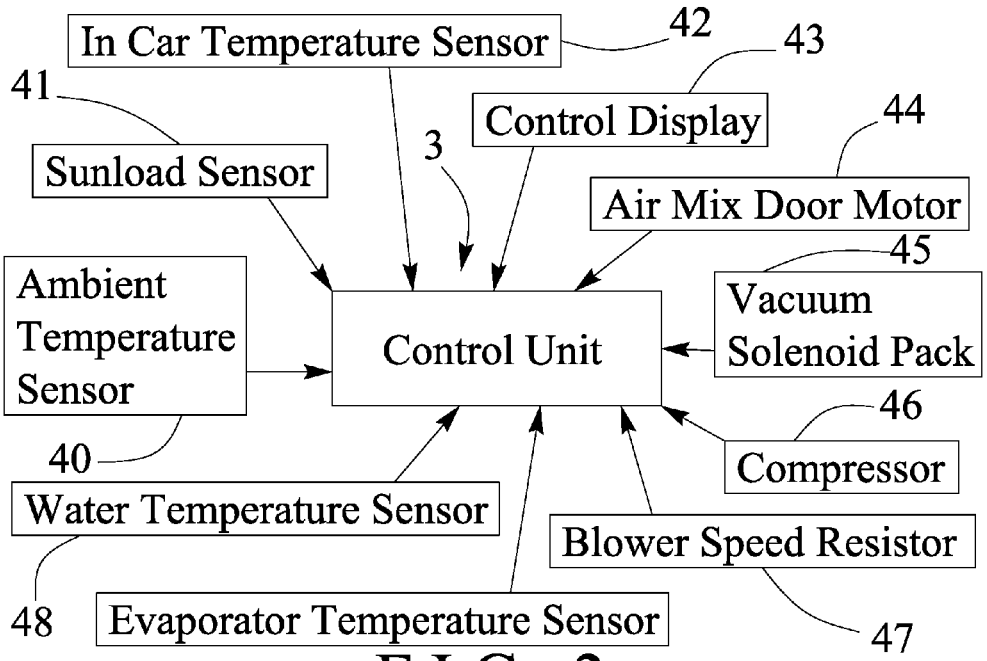
FIG. 2 is a plan schematic view of the diagnostic or analysis device for the vehicle computer control system with input signals/sensors & output control commands illustrating the operation of the diagnostic or analysis device.

As shown in FIG. 2, the electrical control unit 30 may also be provided for connecting or coupling to the sunload sensor 41, in car temperature sensor 42, control display 43, air mix door motor 44, vacuum solenoid pack 45, compressor 46, blower speed resistor 47, water temperature sensor 48, and/or the input sensors 40, such as the evaporator temperature sensor and/or the ambient temperature sensor or the like, in series. Accordingly, the electrical control unit 30 may be easily and quickly and readily and effectively connected or coupled to various kinds of input sensors 40-48 (FIGS. 2, 3) for receiving the input signals therefrom, and the electrical control unit 30 and/or the housing 10 may be easily and quickly and readily and effectively connected or coupled to various kinds of outlet sensors or solenoids or actuators 20 for actuating or operating the actuators 20.

Figure 4:
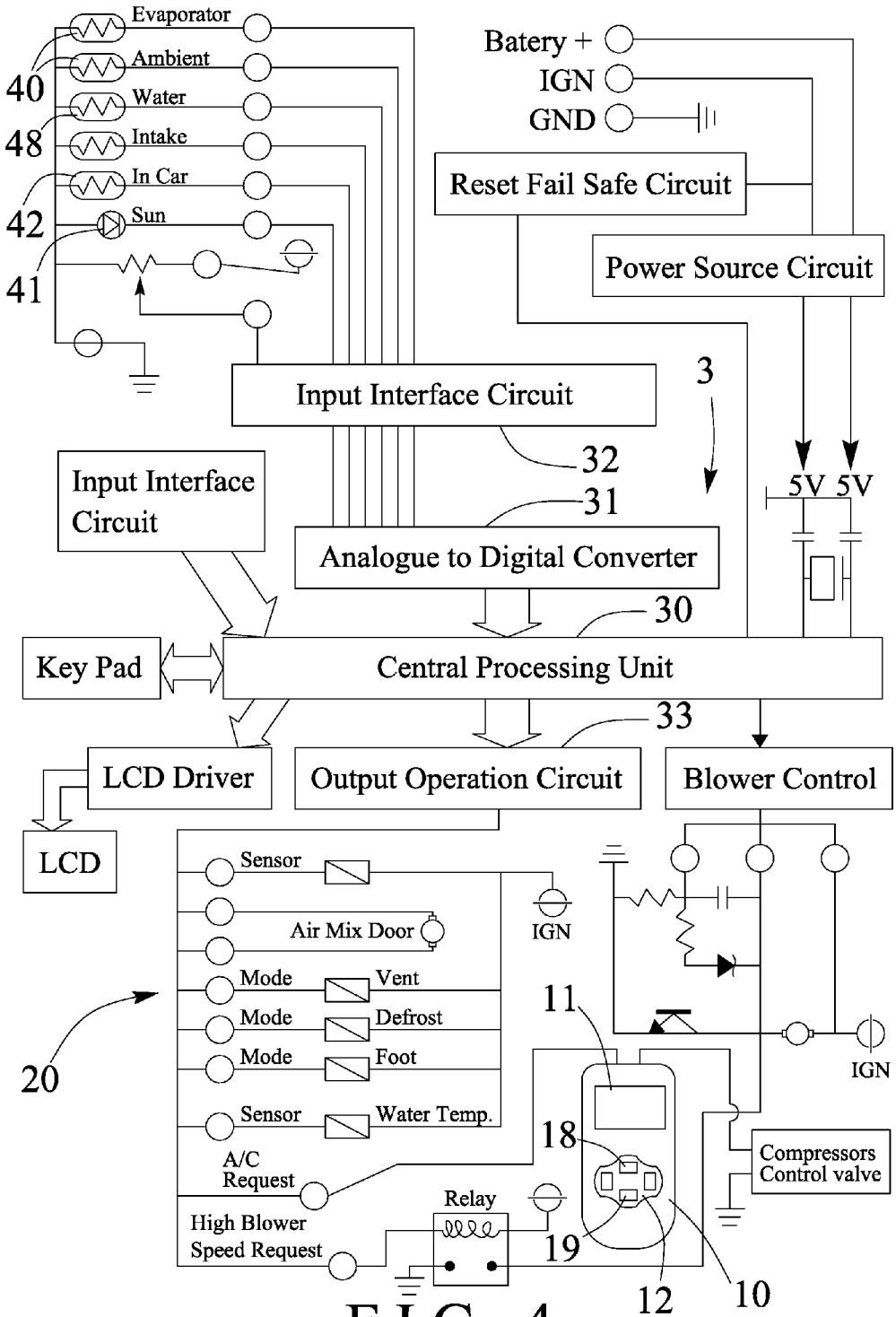
FIG. 4 is another block diagram illustrating the operation of the diagnostic or analysis device.
Figure 5:
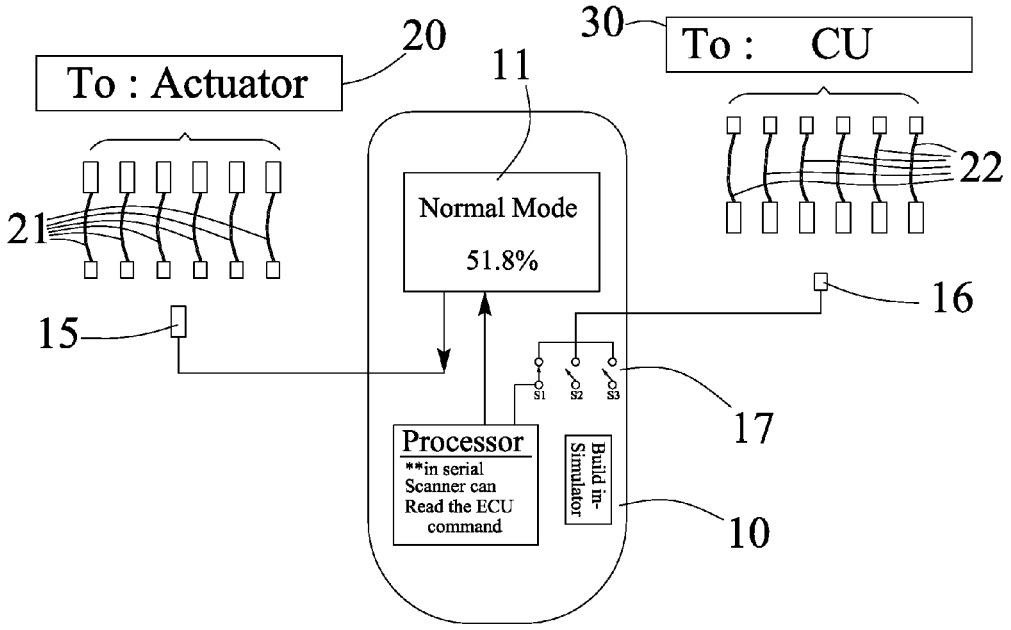
FIGS. 5, 6, 7 are plan schematic view illustrating the operation of the diagnostic or analysis device.
Figure 6:
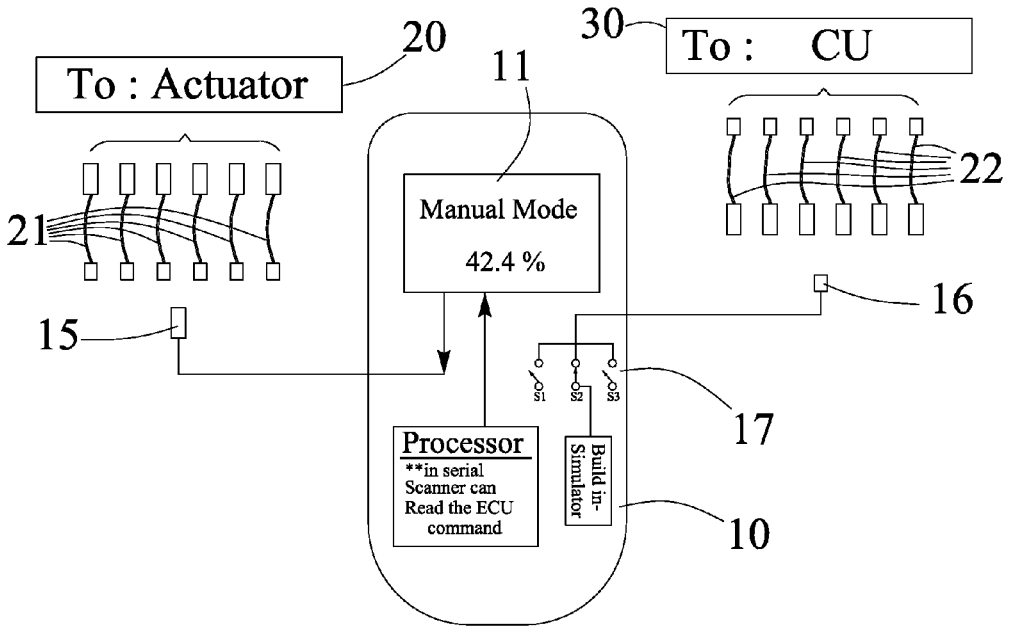
Figure 7:
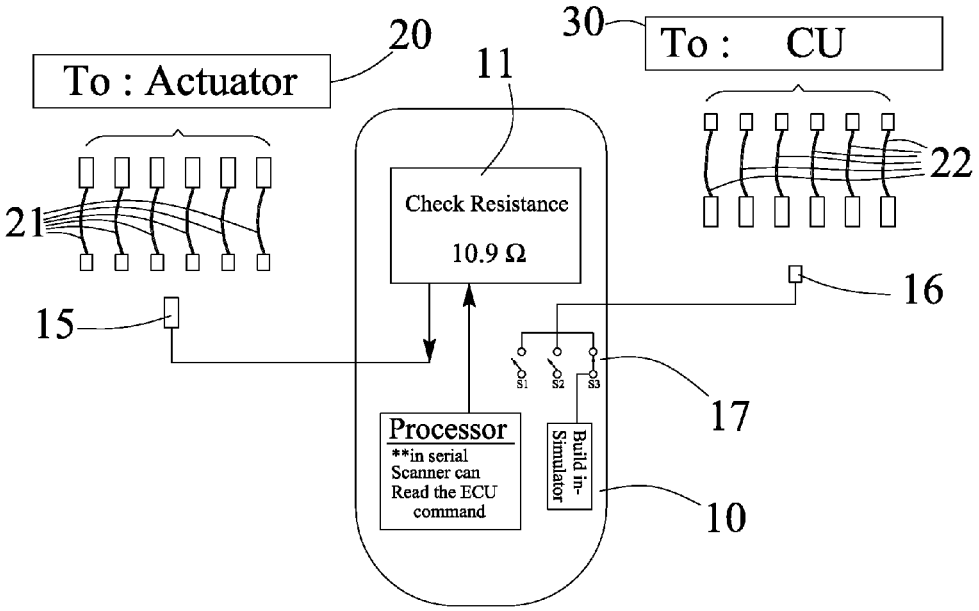

As shown in FIG. 4, the electrical control unit 30 may include a central processing unit 31, an analogue to digital converter 31 and an input interface circuit 32 for connecting or coupling to the input sensors 40-48, and an output operation circuit 33 for connecting or coupling to the outlet sensors or solenoids or actuators 20 and also for connecting or coupling to the central processing unit 31. As shown in FIGS. 5-7, the control panel 12 may include a switch 17 provided for switching or selecting either of three scan circuits S1, S2, S3, for example, as shown in FIG. 5, the switch 17 may be switched to the first scan circuit S1 as a normal mode, or to the second scan circuit S2 as a manual mode (FIG. 6), or to the third scan circuit S3 as a check resistance mode (FIG. 7).

The output signals from the electrical control unit 30 may be seen or viewed or monitored while testing or checking the input signals, the different input signal to the electrical control unit 30 should react a different output signal accordingly. Some of the malfunctions may be correctable onboard a locomotive, and constitute onboard serviceable malfunctions, while the remaining of the malfunctions may only be correctable with the air compressing system being uninstalled and serviced at an off-board servicing site, such malfunctions constitute off-board serviceable malfunctions. The diagnostic or analysis device in accordance with the present invention allows monitoring responses indicative of a malfunction type that may be associated with at least with one of the following: a corrective action that may be performed onboard the locomotive, and a corrective action that may only be performed off-board the locomotive.

Figure 8:
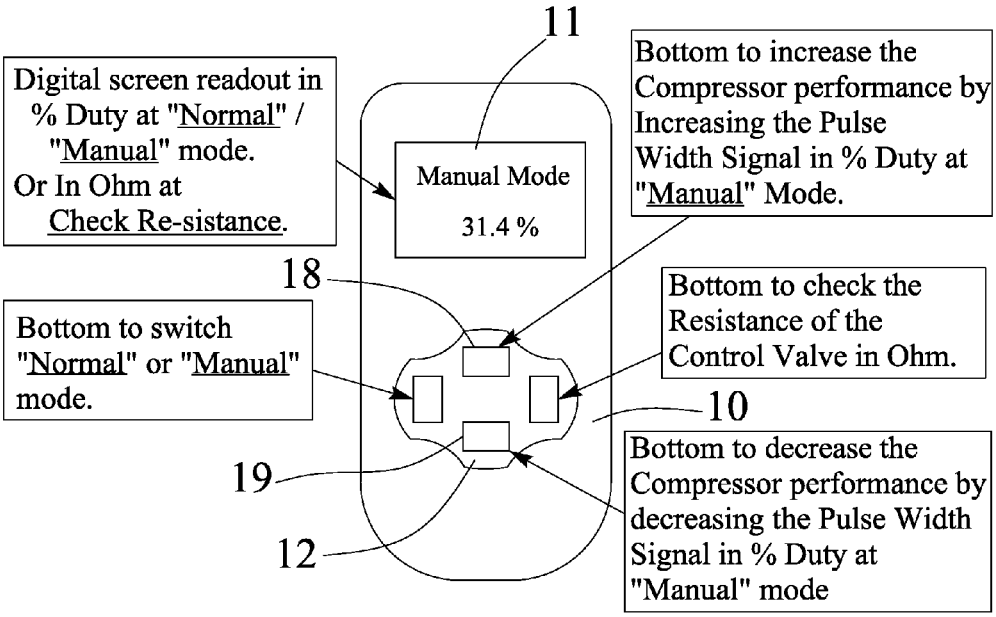
FIG. 8 is a further block diagram illustrating the operating device of the diagnostic or analysis device.

It is to be noted that: at normal mode: digital read out the duty cycle of the command/control of the control unit 30 to the electrical control actuators 20. When switched and at the manual mode, a build-in simulator (not illustrated) will prevent the control unit 30 set a fault code/trouble code while disconnecting the electrical control actuators. At manual mode: pressing the "Up" & "Down" arrow 18, 19 (FIG. 8) to manual control the compressor 46 and drive the compressor 46 from zero (0) to fully open. It is further to be noted that the input/output signals of the control unit 30 may be read or scan while system is running or testing with the first scan circuit S1. Each individual sensor 40, and the solenoids and the actuator 20 and solenoid resistance may be checked anytime with the third scan circuit S3. Each individual sensor 40, and the solenoids and the actuator 20 may be controlled or actuated manually with the second scan circuit S2. The adapters or connectors 21, 22 may be easily, directly and correctly hooked up to the actuators 20 and/or the sensors 40. The signals or digital read outs may be read or scan on the display 11 while system is running or testing.

Accordingly, the diagnostic or analysis device in accordance with the present invention includes an improved and simplified structure or configuration for allowing the user or worker to easily and quickly and readily and effectively diagnose or analyze different parameters of the vehicular engine or air conditioning system of the vehicles, or to identify one or more malfunctions in a locomotive air compressing system and for repairing the locomotive air compressing system.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A diagnostic device for vehicle comprising:

a housing including a display and a control panel provided thereon, said housing including a first attachment and a second attachment, a power source connected to said housing, a control unit connected to said housing, said control unit including an input interface circuit, a central processing unit, an analogue to digital converter connected to said input interface circuit, an output operation circuit, a plurality of input sensors connected to said input interface circuit of said control unit for sending input signals to said control unit, and for displaying said input signals on said display, a plurality of actuators connected to said output operation circuit of said control unit for being controlled and actuated by said control unit, a plurality of first connectors for connecting said actuators to said first attachment selectively, and a plurality of second connectors for connecting said input sensors to said second attachment selectively.

2. The diagnostic device as claimed in claim 1, wherein said first connectors are connected in series.

3. The diagnostic device as claimed in claim 1, wherein said second connectors are connected in series.

4. The diagnostic device as claimed in claim 1, wherein said control panel of said housing include a switch for switching and selecting either of three scan circuits: a first scan circuit S1, a second scan circuit S2, a third scan circuit S3.

5. The diagnostic as claimed in claim 4, wherein said first scan circuit S1 is a normal mode, the second scan circuit S2 is a manual mode, and the third scan circuit S3 is a check resistance mode.

* * * * *